United States Patent [19]

Foster et al.

[11] Patent Number: 4,679,712

[45] Date of Patent: Jul. 14, 1987

[54] ORIFICE COVER SLIDE ACTUATOR LOCK FOR VISCOUS PRODUCT DISPENSER

[75] Inventors: Donald D. Foster; David G. Moore, both of Lee's Summit, Mo.

[73] Assignee: Realex Corporation, Kansas City, Mo.

[21] Appl. No.: 705,240

[22] Filed: Feb. 25, 1985

[51] Int. Cl.[4] ..... B67D 5/40

[52] U.S. Cl. ..... 222/384; 222/402.11; 222/559; 222/153

[58] Field of Search ..... 222/386, 383, 384, 207, 222/401, 402, 402.11, 509, 505, 544, 559, 153, 389, 561, 371, 257, 259, 256

[56] References Cited

U.S. PATENT DOCUMENTS

| | | | |
|---|---|---|---|
| Re. 31,408 | 10/1983 | Czech et al. | 222/384 |
| 2,141,572 | 12/1938 | Tucker | 222/561 |
| 2,532,690 | 12/1950 | Zimmerman | 222/561 |
| 2,652,177 | 9/1953 | Lagemann | 222/509 |
| 2,772,819 | 12/1956 | Poarch et al. | 222/402.11 |
| 2,927,717 | 3/1960 | McDermott | 222/561 |
| 3,367,540 | 2/1968 | Lehmann | 222/153 |
| 3,386,631 | 6/1968 | Kotuby | 222/402.11 |
| 3,734,353 | 5/1973 | McIlhenny | 222/402.11 |
| 3,967,760 | 7/1976 | Marcon | 222/402.11 |

FOREIGN PATENT DOCUMENTS

| | | | |
|---|---|---|---|
| 3006680 | 8/1981 | Fed. Rep. of Germany | 222/386 |
| 0084638 | 3/1983 | Fed. Rep. of Germany | 222/207 |

OTHER PUBLICATIONS

U.S. Ser. No. 06/565,540; filed Dec. 27, 1983; Pastry Product Dispenser Having Combination Actuator and Outlet Valve.

*Primary Examiner*—Joseph J. Rolla
*Assistant Examiner*—Kenneth Noland
*Attorney, Agent, or Firm*—Schmidt, Johnson, Hovey & Williams

[57] ABSTRACT

The dispensing pump has an actuator button which is depressible immediately alongside of the stationary discharge spout of the pump so that, when the button is fully extended in its standby position, its upper surface is approximately flush with the upper end extremity of the spout. A locking cover on the button may be slid into a closed position at this time covering the open end of the spout to both seal the latter and securely lock the button against accidental depression. An alternative embodiment provides a discharge passage within the button itself which may be opened and closed by appropriate positioning of a slide cover carried by the button.

5 Claims, 5 Drawing Figures

ORIFICE COVER SLIDE ACTUATOR LOCK FOR VISCOUS PRODUCT DISPENSER

TECHNICAL FIELD

This invention relates to the field of dispensing pumps, and more particularly, to pumps of the type which are especially suited for dispensing rather viscous products such as toothpaste. More particularly, the invention relates to improvements in the way in which the discharge spouts associated with such dispensers may be effectively closed off or sealed during periods of nonuse.

BACKGROUND

Many lotions, creams, toothpastes, and other products have a tendency to cake and thus clog up discharge orifices through which they are normally dispensed, and, thus, it is desirable during periods of nonuse to somehow provide for the closing and the sealing of such orifices to preclude the admittance of ambient air. One prior dispensing pump providing a closure for the discharge spout while also functioning as a shutoff valve is disclosed and claimed in pending application Ser. No. 06/565,540; filed Dec. 27, 1983, in the name of Ford et al., titled "PASTRY PRODUCT DISPENSER HAVING COMBINATION ACTUATOR AND OUTLET VALVE", and assigned to the assignee of the present invention.

While the mechanism disclosed in said prior application solves the problem of sealing off the spout during idle times, there is nothing in that construction which also provides for locking the actuator of the pump against accidental operating depression.

SUMMARY OF THE PRESENT INVENTION

Accordingly, one important object of the present invention is to provide a dispensing pump, particularly well suited for viscous products, wherein the depressible actuating button thereof is provided with a slide member which can be thumb or finger operated relative to the button itself for movement into and out of a position wherein the member not only covers and seals off the discharge orifice of the spout, but also overlies the same in such a manner that the button is effectively locked against accidental operating depression. The leading extremity of the slide is beveled to present a relatively sharp edge which slides across the orifice during placement of the member in the locking mode whereby to cleanly sever the dispensed ribbon of toothpaste or other product from the spout and thereby promote neat, sanitary usage of the dispenser.

DETAILED DESCRIPTION

Figure 1:
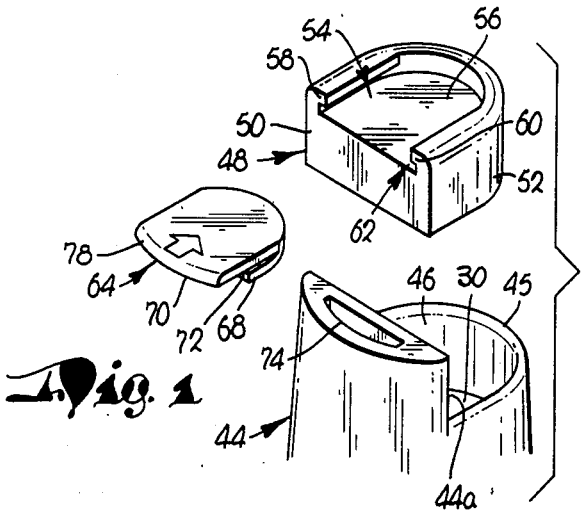
FIG. 1 is a fragmentary, exploded view of the top end of a dispenser constructed in accordance with the principles of the present invention showing details of construction of the spout, actuating button, and cover slide.

The dispenser 10 has a tubular, cylindrical body 12 provided with an internal, primary chamber 14 for holding a supply of product to be dispensed. The lower end of the body 12 is open except for the presence of a floating take-up piston 16 having upper and lower, outwardly-flaring peripheral sealing skirts 18 and 20 which wipe along the interior surface 12*a* of the body 12 during operation. The piston 16 is free to rise within the chamber 14 but is prevented from reverse, downward movement by anti-retrograde means 22 which may take the form, for example, of a downwardly and outwardly flaring metal skirt 24 secured adjacent the bottom of the piston 16 and capable of biting into the wall surface 12*a* when downward pressure is exerted upon the piston 16. Thus, skirt 24 is adequate to prevent reverse movement of piston 16, yet by virtue of inherent resiliency, is capable of flexing to the extent necessary to permit the piston 16 to move upwardly within the chamber 14 at the proper times.

The upper end of the body 12 is provided with a secondary, pumping chamber 26 disposed transversely centrally of the body 12 and defined in part by a continuous annular wall 28 of such dimensions that the diameter of the secondary chamber 26 is considerably less than the diameter of the primary chamber 14. The secondary chamber 26 has a top, transverse wall 30 scanning the annular wall 28 and provided with a central, normally vertically disposed hub or sleeve 32 that reciprocably receives the stem 34 of a pumping piston 36. Then enlarged head 38 of the piston 36 is disposed within the secondary chamber 26 and has peripherally disposed, outwardly flaring, upper and lower skirts 40 and 42 respectively which make sealing engagement with the interior surface of the annular wall 28. As clearly illustrated, the lower end of the secondary chamber 26 is in direct open communication with the primary product chamber 14.

The body 12 is also provided at its upper end with a discharge spout 44 rising upwardly alongside the secondary chamber 26 outboard of the wall 28 and projecting beyond the top wall 30. A generally U-shaped, continuous wall 45 rises upwardly from the top wall 30 along its peripheral extremity and is secured to the inboard surface 44*a* of spout 44 at a pair of normally horizontally spaced locations on the latter so as to define an open-top receiving socket 46 for an actuator button 48 secured to the upper end of the piston stem 34. The button 48 has one vertical, flat face 50 thereof engageable with and slideable along surface 44*a* of spout 44 during recriprocation of the button 48, and the remaining peripheral, vertical face 52 of button 48 is configured in a complementary manner to the U-shaped wall 45 so as to be properly confined thereby without binding contact during such reciprocation.

The upper extremity of the button 48 is provided with a recess 54 having a floor 56 and a pair of opposite, laterally inwardly projecting, overhanging ledges 58 and 60 that are spaced above the floor 56 so as to define a guide track 62 for a cover slide member 64 of generally flat overall configuration matching the configuration of the recess 54 so that the top surface of the slide 64 is flush with the top surface of the button 48. Laterally outwardly projecting lugs 66 and 68 on opposite sides of the slide 64 adjacent the lower, rear extremities thereof fit within the guide track 62 beneath overhanging ledges 58 and 60. The slide 64 is undercut at its forward extremity whereby to present a forewardmost overhanging portion 70 that overlies spout 44 when slide 64 is in its closed position. A forwardly facing, lower transverse shoulder 72 is defined across the slide 64 on the bottom of the latter at the rear extremity of the undercut for engagement with spout 44 when slide 64 is shifted to its closed position, whereby to limit the extent of forward movement of slide 64.

The button 48 is biased yieldably upwardly by a coil spring 76 encircling the stem 34 between the bottom of button 48 and the top wall 30 to such an extent that the underside of the slide portion 70 is substantially flush with the outlet orifice 74 of the spout 44 when button 48 is fully raised. It will be noted in this respect that the head 38 of the piston 36 engages the underside of top wall 30 or hub 32 when the button 48 is fully raised so as to provide a positive limit. Thus, the slide 64 can be readily shifted between its closed position of FIG. 2 overlying the outlet orifice 74 and its open position of FIG. 3 fully within the confines of the button 48. The leading, outboard edge 78 of the slide 64 is preferably beveled so as to provide a relationship sharp extremity capable of cutting through the bead of product being dispened as will hereinafter be made apparent.

OPERATION

As is apparent from the foregoing description, the pump 10 is operated by depressing the actuator button 48. In this respect, as button 48 is depressed, the piston 34 moves downwardly within the secondary chamber 26, which is filled with product along with the primary chamber 14 and the spout 44, such that product is forced upwardly through the spout 44 and out the orifice 74. Because of the anti-retrograde skirt 24 associated with the take-up piston 16, the piston 16 cannot move downwardly and the only recourse is for the products to leave the pump through the spout 44.

When the button 48 is released, the coil spring 76 returns the button 48 and the piston 36 to their normal undepressed positions, creating a void within the secondary chamber 26. If the product being dispensed is of sufficiently high viscosity, such material within the spout 44 will serve as its own check valve and will not be sucked back down into the chamber 12 from the spout 44, thus causing the take-up piston 16 to rise within the chamber 14 under the influence of atmospheric pressure on its bottom side and move product upwardly in an amount matching the volume of product evacuated. It is to be understood that, in the event the viscosity of the product being dispensed is not sufficiently high as to permit such product to function as its own check valve, a suitable ball check valve or flapper valve should be installed in association with the spout 44 to assure that the take-up piston 16 functions properly.

Figure 4:
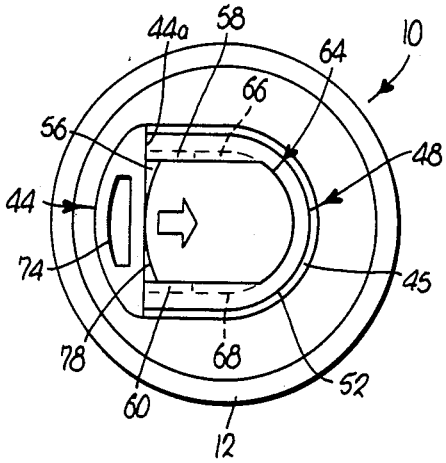
FIG. 4 is a top plan view of the dispenser with the cover slide in its open position.
Figure 3:
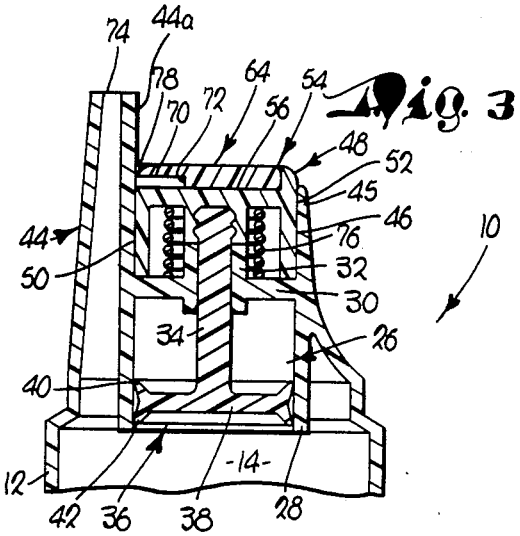
FIG. 3 is a fragmentary vertical cross-sectional view of the dispenser showing the cover slide in its open position and the dispensing button depressed through an operating stroke.

During reciprocation of the button 48, the cover slide 64 is retracted back into the recess 54 as illustrated in FIGS. 3 and 4 so as to avoid impeding proper functioning of the button 48. The topmost surface of the slide 64 is fully exposed although flush with the surrounding surface of the button 48 so as to conveniently accept the application of manual pumping force applied to the button 48.

Figure 2:
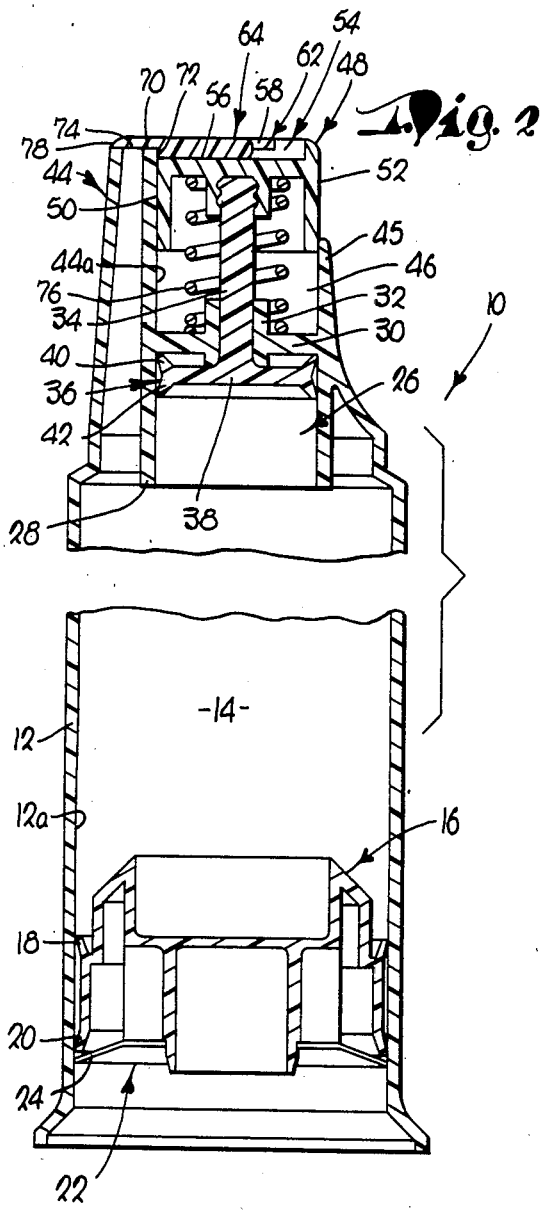
FIG. 2 is a fragmentary vertical cross-sectional view of the dispenser showing the actuating button in a fully-raised, standby position and the cover slide shifted to a closed position sealing off the spout and locking the button against depression.

When the button 48 is in its upper, fully extended position as shown in FIG. 2, the slide 64 may be shifted by thumb pressure or otherwise into fully covering relationship with the outlet orifice 74, thereby not only sealing the latter against the admittance of ambient air and the egress of product from spout 44, but also effectively locking the button 48 against depression, since any attempted movement of the button 48 in this respect will simply cause the slide 64 to bear downwardly against the interfering spout 44. Hence, to depress the button 48, the slide 64 must first be retracted into its open position.

It is also to be appreciated that by virtue of the beveled leading edge 78 of the slide 64, any bead of product tending to otherwise cling to the spout 44 following the dispensing stroke may be cleanly severed and separated from the spout 44 by simply shifting slide 64 into its closed position after the button 48 is returned to its raised position. This provides a neat, sanitary arrangement in the vicinity of the discharge orifice 78.

Preferably, the majority of the components of the pump 10 can be molded from a suitable synthetic resinous material to facilitate manufacture.

ALTERNATIVE EMBODIMENT

Figure 5:
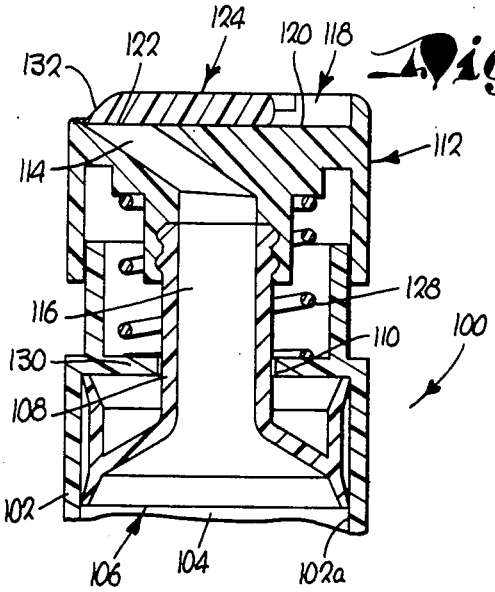
FIG. 5 is a fragmentary, vertical cross-sectional view of an alternative embodiment wherein the dispensing passage is directed through the actuating button itself and the cover slide is illustrated in a closed position relative to the outlet orifice of such passage.

The dispensing pump 100 of FIG. 5 is similar in some respects to the pump 10 of FIGS. 1–4, but also differs in significant ways. As in the pump of the first embodiment, the pump 100 includes a generaly tubular body 102 having an internal chamber 104, but instead of a secondary pumping chamber, the chamber 104 serves both as the main product chamber and the pumping chamber, there being a pumping piston 106 located within the chamber 104 and reciprocable in sealing, wiping engagement with the interior wall surface **102*a* thereof. An axially disposed, upwardly extending, tubular stem 108 on the piston 106 projects through a clearance opening 110 in the upper end of the chamber 104 and is secured at its upper end to an actuator button 112 having an internally disposed, upwardly and outwardly inclined discharge passage 114 that communicates at its lower end with an internal passage 116 within the piston stem 108**.

The uppermost extremity of the button 112 is provided with a recess 118 therein having a floor 120 which is intersected by the passage 114 at its upper, outboard extremity to define an outlet orifice 122. A cover slide 124 is transversely reciprocable within the recess 118 along the floor 120 between a closed position covering and sealing off the orifice 122 and an open position (not shown) wherein the slide 124 is retracted back away from the orifice 122 for opening the latter. Although not shown, it is to be understood that preferably the slide 124 is retained within a guideway or track in the same manner as the slide 64 is retained by the track 62 in the first embodiment.

A coil spring 128 is trapped beneath the underside of the button 112 and a transverse wall 130 at the upper end of the chamber 104 so as to yieldably bias the button 112 and the piston 106 to the extended postion illustrated in FIG. 5. When the slide 124 is retracted to its open position, the button 112 may then be depressed against the action of the spring 128, causing product within the chamber 104 to rise upwardly within the passages 116 and 114 for discharge through the outlet 122. On the other hand, when the slide 124 is in its closed position covering the outlet 122, the latter is sealed and no product may be dispensed, notwithstanding attempted depression of the button 112. Preferably, the leading edge 132 of the slide 124 is beveled in the same manner as the edge 78 of slide 64 and for the same purpose. Likewise, preferably the pump 100 is provided with a floating take-up piston in the nature of the take-up piston 16 associated with the first embodiment. For convenience, the majority of components of the pump 100 may be molded out of suitable synthetic resinous material such as that selected for use in connection with the first embodiment.

We claim:

1. In a dispensing pump having a discharge spout and a depressible actuator adjacent the spout for operating the pump, the improvement comprising:

a locking cover shiftably carried by said actuator for movement relative to the latter between an open position opening the spout and a closed position closing the spout, said cover being disposed when in said open position to clear the spout for unimpeded depression of the actuator and when in said closed position to overlie the spout and lock the actuator against depression, said actuator being provided with means adjacent the upper extremity thereof defining a transverse guide track with respect to the path of travel of the actuator during depression thereof, said cover being slidably received in said track for movement between said open and closed positions thereof, the pump including a tubular body having a primary product chamber and a secondary pumping chamber for communication with the primary chamber, said spout being disposed for communication with the primary chamber, and said secondary chamber having a reciprocable pumping piston therein coupled with the actuator for movement therewith during depression of the actuator.

2. In a dispensing pump as claimed in claim 1, wherein said secondary pumping chamber and the spout are in constantly open communication with the primary chamber.

3. in a dispensing pump having a discharge spout and a depressible actuator adjacent the spout for operating the pump, the improvement comprising:

a locking cover shiftably carried by said actuator for movement relative to the latter between an open position opening the spout and a closed position closing the spout, said cover being disposed when in said open position to clear the spout for unimpeded depression of the actuator and when in said closed position to overlie the spout and lock the actuator against depression, the pump including a tubular body having a primary product chamber and a secondary pump chamber for communication with the primary chamber, said spout being disposed for communication with the primary chamber, and said secondary chamber having a reciprocable pumping piston therein coupled with the actuator for movement therewith during depression of the actuator, said secondary chamber being provided with a top wall, said piston having a stem reciprocable through said top wall and secured at its upper end to said actuator, said spout projecting upwardly alongside the secondary chamber and beyond said top wall to provide a sliding guide surface for said actuator during reciprocation thereof.

4. In a dispensing pump as claimed in claim 3, wherein said top wall of the primary chamber is provided with an upright, continuous wall rising from the top wall about a periphery extremity thereof and joining said guide surface of the spout at a pair of normally horizontally spaced locations thereon to cooperate with said guide surface in defining a receiving and guiding socket for the actuator during depression thereof.

5. In a dispensing pump as claimed in claim 3, wherein said secondary pumping chamber and the spout are in constantly open communication with the primary chamber.

* * * * *